US010310539B2

(12) United States Patent
Marinca

(10) Patent No.: US 10,310,539 B2
(45) Date of Patent: Jun. 4, 2019

(54) PROPORTIONAL TO ABSOLUTE TEMPERATURE REFERENCE CIRCUIT AND A VOLTAGE REFERENCE CIRCUIT

(71) Applicant: Analog Devices Global, Hamilton (BM)

(72) Inventor: Stefan Marinca, Limerick (IE)

(73) Assignee: ANALOG DEVICES GLOBAL, Hamilton (BM)

( * ) Notice: Subject to any disclaimer, the term of this patent is extended or adjusted under 35 U.S.C. 154(b) by 0 days.

(21) Appl. No.: 15/248,694

(22) Filed: Aug. 26, 2016

(65) Prior Publication Data

US 2018/0059707 A1 Mar. 1, 2018

(51) Int. Cl.
*G05F 3/16* (2006.01)
*G05F 3/26* (2006.01)

(52) U.S. Cl.
CPC ..... *G05F 3/267* (2013.01)

(58) Field of Classification Search
CPC . G05F 3/26; G05F 3/262; G05F 3/265; G05F 3/267
USPC ..... 323/311, 312, 313, 314, 315, 316, 317; 327/539
See application file for complete search history.

(56) References Cited

U.S. PATENT DOCUMENTS 5,352,973 A * 10/1994 Audy ..... G05F 3/30 323/313
6,225,856 B1 * 5/2001 Toth ..... G05F 3/30 323/313
2004/0124825 A1 * 7/2004 Marinca ..... G05F 3/30 323/316
2005/0122091 A1 * 6/2005 Marinca ..... G05F 3/30 323/316
2009/0160538 A1 * 6/2009 Marinca ..... G05F 3/30 327/539

(Continued)

FOREIGN PATENT DOCUMENTS

CN 104375553 A 2/2015
CN 204331532 U 5/2015

OTHER PUBLICATIONS

"Machine Translation of CN 104375553A, published on Feb. 25, 2015", 30 pgs.

(Continued)

*Primary Examiner* — Alex Torres-Rivera
(74) *Attorney, Agent, or Firm* — Schwegman Lundberg & Woessner, P.A.

(57) ABSTRACT

The present disclosure relates to a PTAT voltage reference circuit and a temperature independent voltage reference circuit in which the effect of transistor base currents on the circuit output is compensated for. This is achieved by a pair of compensation resistors. The base current from one of the pair of transistors is used to increase the voltage drop across one of the compensation resistors. The base current from the other of the pair of transistors is used to decrease the voltage drop across another of the compensation resistors, by an equal amount. The compensation resistors are connected in series with the resistor which reflects the difference in base-emitter voltage ($\Delta V_{BE}$). The circuit output is measured across the series connected resistors. As such, the base currents are compensated for at the output.

20 Claims, 6 Drawing Sheets

(56) References Cited

U.S. PATENT DOCUMENTS

| | | | | |
|---|---|---|---|---|
| 2009/0302823 | A1* | 12/2009 | Chao | G05F 3/30 323/313 |
| 2014/0117966 | A1* | 5/2014 | Shaeffer | G05F 3/02 323/313 |
| 2015/0160680 | A1* | 6/2015 | Marinca | G05F 3/30 323/313 |
| 2015/0177771 | A1* | 6/2015 | Marinca | G05F 3/185 323/313 |
| 2015/0338872 | A1* | 11/2015 | Afzal | G05F 3/02 323/313 |
| 2016/0026198 | A1* | 1/2016 | Eberlein | G05F 1/575 323/313 |

OTHER PUBLICATIONS

"Machine Translation of CN 204331532A, published on May 13, 2015", 29 pgs.

* cited by examiner

PROPORTIONAL TO ABSOLUTE TEMPERATURE REFERENCE CIRCUIT AND A VOLTAGE REFERENCE CIRCUIT

FIELD OF THE DISCLOSURE

The present disclosure relates to a proportional to absolute temperature (PTAT) reference circuit and a voltage reference circuit. In particular, it relates to a PTAT reference circuit and a voltage reference circuit which compensate for transistor base currents.

BACKGROUND

Electronic circuits typically require voltage or current references in order to operate effectively. Voltage references may be required that are temperature independent. This may be useful in circuits that require a fixed voltage reference. Voltage reference may also be required that are temperature dependent. Such references may be used as temperature sensors. One circuit arrangement commonly used to provide a temperature dependent voltage reference utilises a pair of bipolar junction transistors (BJTs). It is possible to generate a voltage reference that is proportional to absolute temperature (PTAT) by using two BJTs with different collector current densities. The difference in the base-emitter voltages of each BJT can be reflected across a resistor in order to produce a PTAT voltage reference. By combining a PTAT voltage reference with a complimentary to absolute temperature (CTAT) component a voltage reference that is independent of temperature may be provided.

A problem with BJT-based voltage references is that the output is affected by the BJT current gain factor. This is particularly the case in some types of processing, such as CMOS, where BJTs have a low current gain factor. There is therefore a need for voltage reference circuits in which the output voltage reference is not affected by the BJT base currents.

SUMMARY OF THE DISCLOSURE

The present disclosure relates to a PTAT voltage reference circuit and a temperature independent voltage reference circuit in which the effect of transistor base currents on the circuit output is compensated for. This is achieved by a pair of compensation resistors. The base current from one of the pair of transistors is used to increase the voltage drop across one of the compensation resistors. The base current from the other of the pair of transistors is used to decrease the voltage drop across another of the compensation resistors, by an equal amount. The compensation resistors are connected in series with the resistor which reflects the difference in base-emitter voltage ($\Delta V_{BE}$). The circuit output is measured across the series connected resistors. As such, the base currents are compensated for at the output.

In certain embodiments the disclosure provides a proportional to absolute temperature, PTAT circuit, the circuit comprising: a first bipolar transistor arranged to generate a first base-emitter voltage and a first base current and a second bipolar transistor arranged to generate a second base-emitter voltage and a second base current; and a plurality of passive components, coupled to the first and second bipolar transistors; wherein the circuit is configured to generate a PTAT output voltage, across the plurality of passive components, which is dependent on a difference in the first and second base-emitter voltages; and the plurality of passive components are configured to compensate for the first and second base currents.

In certain embodiments the disclosure provides a temperature independent voltage reference, the circuit comprising: a first bipolar transistor arranged to generate a first base-emitter voltage and a first base current and a second bipolar transistor arranged to generate a second base-emitter voltage and a second base current; a plurality of passive components, coupled to the first and second bipolar transistors; and a complementary to absolute temperature, CTAT, component, coupled to the plurality of passive components; wherein the circuit is configured to generate a temperature independent output voltage, across the plurality of passive components and the CTAT component; and the plurality of passive components are configured to compensate for the first and second base currents.

In certain embodiments the disclosure provides a method of generating a proportional to absolute temperature, PTAT, voltage, the method comprising: providing a circuit comprising a first bipolar transistor, a second bipolar transistor and a plurality of passive components, coupled to the first and second bipolar transistors; generating, at the first bipolar transistor, a first base-emitter voltage and a first base current and, at the second bipolar transistor, a second base-emitter voltage and a second base current; generating a PTAT output voltage, across the plurality of passive components, which is dependent on a difference in the first and second base-emitter voltages; and compensating for the first and second base currents, using the plurality of passive components.

BRIEF DESCRIPTION OF THE DRAWINGS

The present disclosure will now be described in more detail, by way of example only, and with reference to the accompanying drawings, in which.

DETAILED DESCRIPTION

The present disclosure provides a PTAT voltage reference circuit and a temperature independent voltage reference. In the PTAT circuit, the difference in the voltage between the base-emitter voltage of one transistor of a pair of transistors, and the base-emitter voltage of another transistor of the pair, is reflected across a resistor coupled between the two transistor bases. This voltage is proportional to absolute temperature and depends on the collector current density ratio of the two transistors. If this resistor were connected to an output and ground, the output would be affected by the base currents of the transistors. This is because the base current of one of the transistors is directed to ground, while the base current of the other transistor passes through the resistor. To compensate for this, two compensation resistors are provided in series with the PTAT resistor. One of the resistors is coupled to ground. The other is coupled to the output. As a result of this, the current through one of the resistors is the current through the PTAT resistor plus the base current of one of the transistors. The current through the other resistor is the current through the PTAT resistor minus the base current of the other resistor. Assuming the compensation resistors and the base currents take the same values, then one of the resistors positively increases the voltage dropped across it by an amount equivalent to the base current, and the other negatively decreases its voltage by the same amount. As such, the output compensates for, or is independent of, the base currents.

Figure 1:
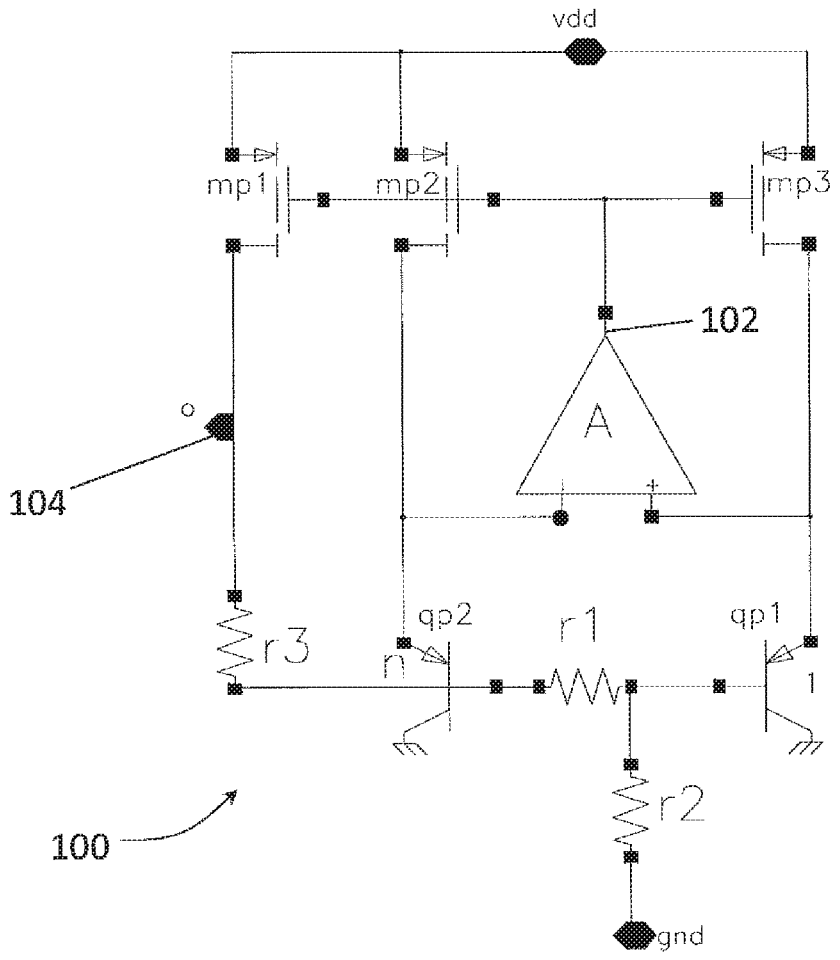
FIG. 1 is a PTAT circuit in accordance with a first embodiment of the disclosure.

FIG. 1 shows a proportional to absolute temperature voltage reference circuit 100 in accordance with an embodiment of this disclosure. The circuit 100 comprises a first PNP bipolar transistor qp1 and a second bipolar transistor qp2. The collectors of each transistor are coupled to ground. The circuit 100 also includes three p-channel metal oxide semiconductor field-effect transistors (MOSFETs) mp1, mp2 and mp3. The emitter of each bipolar transistor is coupled to a drain of a respective MOSFET. In particular, the emitter of qp1 is coupled to the drain of mp3, and the emitter of qp2 is coupled to the drain of mp2. The p-channel MOSFETS are used to control the emitter currents of the bipolar transistors. The source of each MOSFET is coupled to a positive supply, Vdd.

The bases of the bipolar transistors are coupled to respective ends a first resistor r1. In particular, the base of qp1 is coupled to a first end of r1, and the base of qp2 is coupled to a second end of r1. As will be discussed in more detail below, any difference between the base-emitter voltages of qp1 and qp2 will be reflected across r1. The first end of r1 and the base of qp1 are also coupled to a first end of a first compensation resistor r2. The second end of the first compensation resistor is coupled to ground.

The circuit 100 also includes an amplifier A. The amplifier 100 includes a non-inverting input (+), an inverting input (−), and an amplifier output 102. The non-inverting input (+) is coupled to the emitter of qp1 and the drain of mp3. The inverting input (−) is coupled to the emitter of qp2 and the drain of mp2. During operation, the two amplifier inputs are at the same potential, and therefore ensure that the potential at the emitters of qp1 and qp2 are the same. As discussed in more detail below, this ensures that any difference between the base-emitter voltages of qp1 and qp2 is reflected across r1. The amplifier output 102 is coupled to the gates of mp1, mp2 and mp3.

The circuit 100 also includes a PTAT output node, 104. The PTAT output 104 is coupled to a first end of a second compensation resistor r3. A second end of r3 is coupled to a base of transistor qp2. The PTAT output 104 is also coupled to a drain of MOSFET mp1. As such, the resistors r1, r2 and r3 are coupled together in series between the PTAT output 104 and ground. The values of the resistors are set such that r2=r3. r1 may take a value different to that of r2 and r3. The voltage $V_O$ developed at the output 104 is defined by the following equation:

$$V_O=V_{r1}+V_{r2}+V_{r3} \tag{1}$$

Here $V_{r1}$, $V_{r2}$ and $V_{r3}$ are the corresponding voltage drops across the three resistors.

The bipolar transistor qp1 has an emitter area of unity. The bipolar transistor qp2 has an emitter area of n times unity. As such, if qp1 and qp2 are fed with the same emitter current, then the base-emitter voltage of qp2 will be lower than the base-emitter voltage of qp1. The amplifier A ensures that the same voltage is present at both the inverting (−) and non-inverting (+) inputs. The emitter voltages of qp1 and qp2 are therefore the same. As such, the difference in base-emitter voltage ($\Delta V_{BE}$) is reflected across r1.

The voltage dropped across r1 is $\Delta V_{BE}$, and hence is strictly dictated by the collector current density ratio of qp1 and qp2. As such, the current generated in r1 is dependent on $\Delta V_{BE}$ and the value of r1, and not on the base currents generated by qp1 and qp2. The base current of qp1 is driven through r2. As such, the voltage developed across r2 is dependent on the current generated by r1, the base current of qp1 and the value of resistor r2. The current driven through r3 is the current driven through r1, less the base current of qp2. As such, assuming that r2=r3, the base currents effectively cancel, and $V_O$ is dependent on $\Delta V_{BE}$ but independent of the base currents of qp1 and qp2.

Following on from equation 1 above:

$$V_O=\Delta V_{BE}+I_{r2}\cdot r2+I_{r3}\cdot r3 \tag{2}$$

Since $I_{r2}=I_{r1}+I_{Bqp1}$ (where $I_{Bgp1}$ is the base current of qp1) and since $I_{r3}=I_{r1}-I_{Bqp2}$ (where $I_{Bqp2}$ is the base current of qp2), $V_O$ is given by:

$$V_O-\Delta V_{BE}+(I_{r1}+I_{Bgp1})\cdot r2+(I_{r1}-I_{Bqp2})\cdot r3 \tag{3}$$

Therefore:

$$V_O=\Delta V_{BE}+I_{r1}\cdot r2+I_{Bqp1}\cdot r2+I_{r1}\cdot r3-I_{Bqp2}\cdot r3 \tag{4}$$

Given that $I_{Bqp1}$ and $I_{Bqp2}$ are equal, and that r2 is equal to r3, the equation can be reduced to:

$$V_O=\Delta V_{BE}+I_{r1}\cdot r2+I_{r1}\cdot r2 \tag{5}$$

Therefore:

$$V_O=\Delta V_{BE}+2\cdot I_{r1}\cdot r2 \tag{6}$$

Substituting $I_{r1}$ for $\Delta V_{BE}$/r1, gives:

$$V_O=\Delta V_{BE}+2\cdot\Delta V_{BE}\cdot r2/r1 \tag{6}$$

Therefore:

$$V_O=\Delta V_{BE}\cdot(1+2\cdot r2/r1) \tag{7}$$

As such, the output 104 is dependent only on $\Delta V_{BE}$ and the values of resistors r2 and r1. As such, the output is independent of the current gain factor of the bipolar transistors.

A further advantage of this circuit arrangement relates to the fact that the current flowing through r1 is not the same as the emitter currents. As such, the current through r1 may be much larger than the emitter currents. The larger the current through r1 is with respect to the base currents, the greater the base current effect is attenuated. This also helps with reducing the wide band noise, which is dominated by the r1 value.

Figure 2:
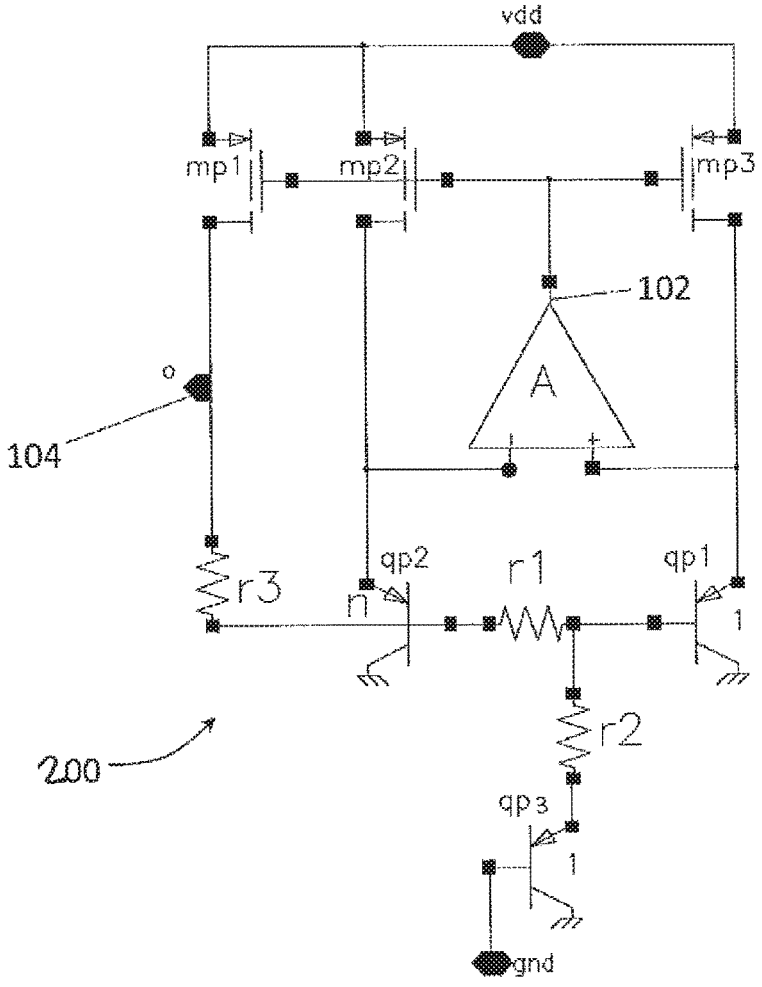
FIG. 2 is a voltage reference circuit in accordance with a second embodiment of the disclosure.

FIG. 2 shows a circuit 200 in accordance with an embodiment of the disclosure. Many of the components of circuit 200 are the same as the components of circuit 100. These elements are referred to using the same references, and will not be described again here. The only difference between circuit 100 and circuit 200, is that circuit 200 includes a further bipolar transistor qp3. The emitter of qp3 is coupled to the second end of the first compensation resistor r2. The base and the collector of qp3 are coupled to ground. qp3 produces an output voltage that is a complimentary to absolute temperature (CTAT). As such, the circuit output 104 can be set independent of temperature, and may be used as a temperature independent voltage reference.

The output voltage 104 of circuit 200 is given by:

$$V_O=V_{BEqp3}+V_{r1}+V_{r2}+V_{r3} \tag{8}$$

As such, the PTAT voltage developed across $V_{r1}$, $V_{r2}$ and $V_{r3}$ is combined with the CTAT voltage developed across qp3 to produce an output voltage that is temperature independent. The emitter current of qp3 is the same as the current in r2. $I_{r2}$ is given by:

$$I_{r2}=\Delta V_{BE}/r1+I_{Bqp1} \quad (9)$$

Assuming that the aspects ratios of mp1, mp2 and mp3 are the same then the base current of qp3 is the same as the base current of qp1, and as such the collector current of qp3 becomes:

$$I_{Cqp3}=\Delta V_{BE}/r1 \quad (10)$$

As such, the base current is also compensated for in qp3.

Figure 3:
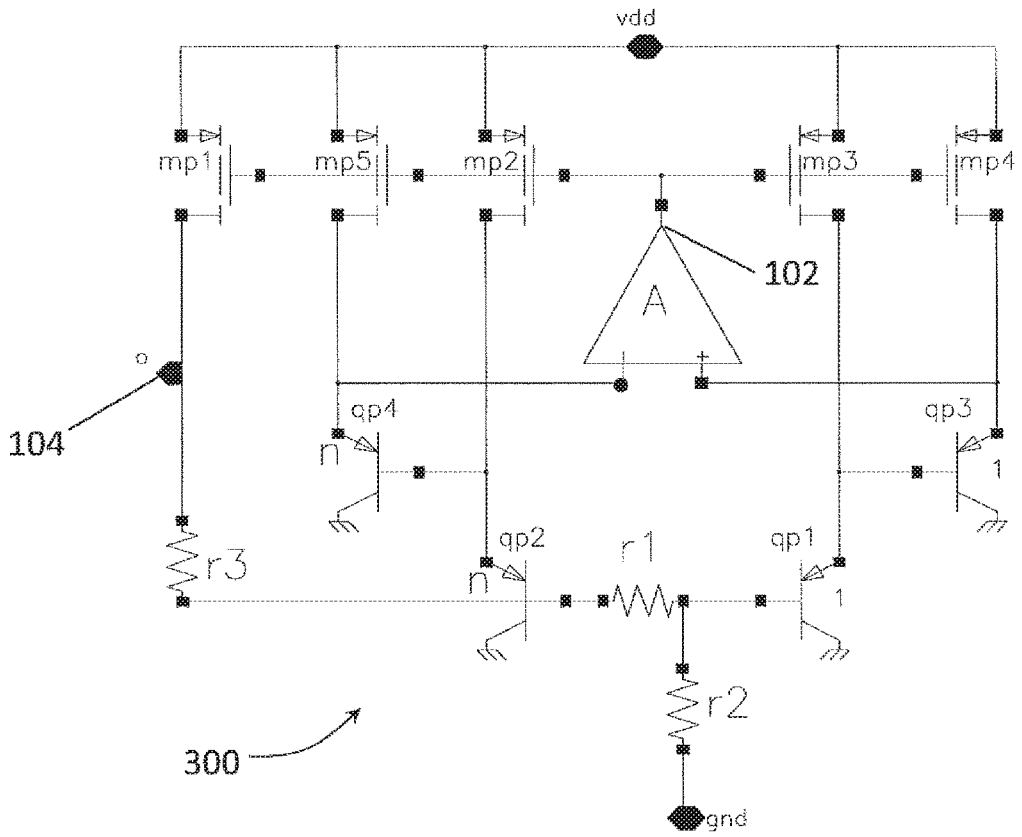
FIG. 3 is a PTAT circuit in accordance with a third embodiment of the disclosure.

FIG. 3 shows a PTAT circuit 300 in accordance with a further embodiment of the disclosure. Many of the components of circuit 300 are the same as the components of circuit 100. These elements are referred to using the same references, and will not be described again here. The PTAT circuit 300 includes a stack architecture. In particular, in addition to bipolar transistors qp1 and qp2, the circuit 300 includes bipolar transistors qp3 and qp4, arranged in a stack configuration. The circuit 200 also includes additional p-channel MOSFETs mp4 and mp5.

The bases of transistors qp3 and qp4 are coupled to the emitters of transistors qp1 and qp2 respectively. The collectors of transistors qp3 and qp4 are coupled to ground. The emitter of qp3 is coupled to the non-inverting input (+) of amplifier A. In contrast to circuit 100, the non-inverting input (+) is not coupled to the emitter of qp1. The emitter of qp4 is coupled to the inverting input (−) of amplifier A. In contrast to circuit 100, the inverting input (−) is not coupled to the emitter of qp2. As such, the amplifier A controls the potential at the emitters of qp3 and qp4, rather than qp1 and qp2.

The output 102 of amplifier A is coupled to the gates of mp4 and mp5. The drains of mp4 and mp5 are coupled to the emitters of qp3 and qp4 respectively. The sources of mp4 and mp5 are coupled to the positive supply, Vdd.

The bipolar transistor qp3 has an emitter area of unity. The bipolar transistor qp4 has an emitter area of n times unity. As such, if qp3 and qp4 are fed with the same emitter current, then the base-emitter voltage of qp4 will be lower than the base-emitter voltage of qp3.

In this circuit arrangement, the voltage developed across r1 is the combination of the difference in base-emitter voltages of two pairs of transistors. As such, $V_{r1}$ is double $V_{r1}$ in circuit 100. As such, the amplifier offset voltage effect on the base-emitter voltage difference is reduced. Furthermore, because Vr1 is double Vr1 in circuit 100, the gain factor (the ratio of r2 to r1) can be half that in circuit 100 to achieve the same output voltage.

Figure 4:
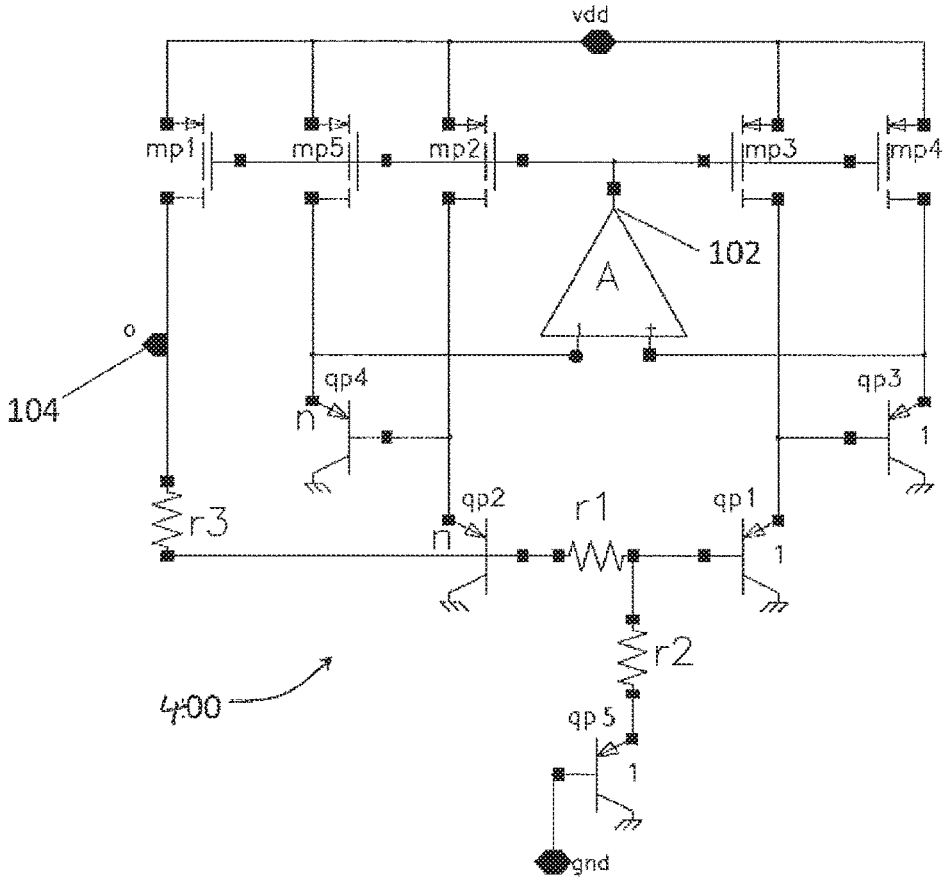
FIG. 4 is a voltage reference circuit in accordance with a fourth embodiment of the disclosure.

FIG. 4 shows a circuit 400 in accordance with an embodiment of the disclosure. Many of the components of circuit 400 are the same as the components of circuit 300. These elements are referred to using the same references, and will not be described again here. The only difference between circuit 300 and circuit 300, is that circuit 300 includes a further bipolar transistor qp5. This is a similar arrangement to that shown in FIG. 2. The emitter of qp5 is coupled to the second end of the first compensation resistor r2. The base and the collector of qp5 are coupled to ground. qp5 is a complimentary to absolute temperature (CTAT) component, and as such, the circuit output is independent of temperature.

The effectiveness of the above-described circuit arrangements for the purposes of compensating for base currents will now be described with reference to circuit 300 and FIG. 3. The circuit 300 was simulated using CMOS processing using substrate bipolar transistors having a "beta" factor of around 25 at ambient temperature. qp1 and qp3 were set to have emitter areas of 5 μm*5 μm. qp2 and qp4 were formed from 26 identical bipolar transistors, connected in parallel, in order to simulate an N of 26. Resistors r1, r2 and r3 were given a value of 17 kΩ. The emitter currents at ambient temperature of the four bipolar transistors qp1 to qp4 were set to 0.28 μA and the current through r1, r2 and r3 were set to approximately 10 μA.

Figure 5:
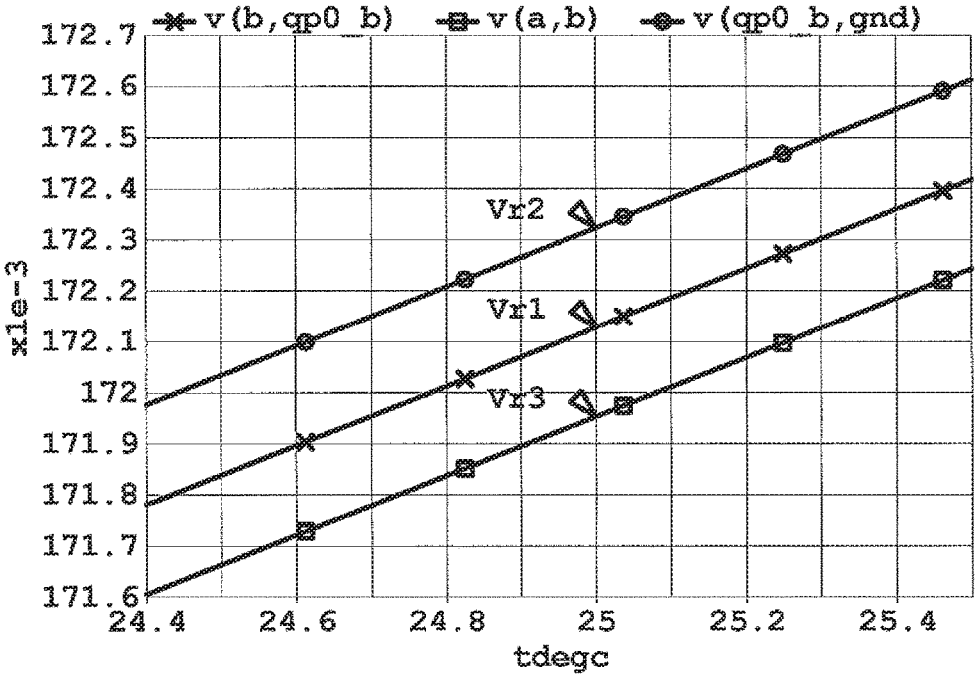
FIG. 5 is a chart showing a simulation of voltage drop across various resistors of the circuit of FIG. 3.

FIG. 5 shows a simulation plot of the voltage drops across each resistor r1 to r3 against temperature, assuming that the three resistors have the same value. As can be seen, the voltage drop across r2 is slightly higher than r1 owing to the base current of qp1. The voltage drop across r3 is lower than that across r1 by the same amount, owing to the base current of qp2. As such, the output voltage is exactly three times the voltage across r1, i.e. three times $\Delta V_{BE}$. Therefore, the base currents are compensated.

Figure 6:
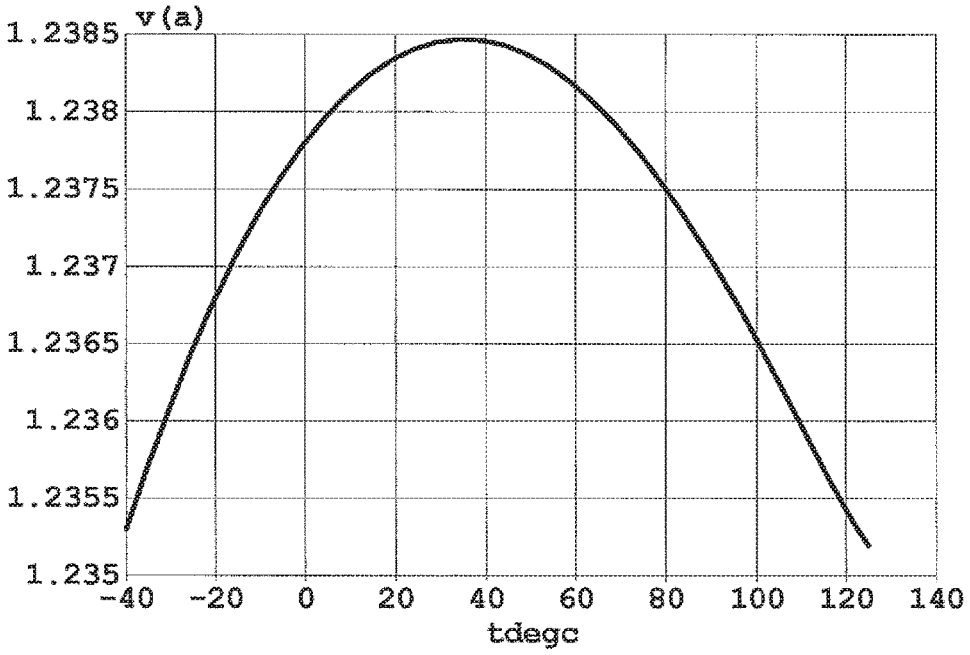
FIG. 6 is a chart showing a simulation of output voltage versus temperature for the circuit shown in FIG. 2.

FIG. 6 is a chart showing the simulated voltage at the output of circuit 200. As can be seen, the voltage has very little variation from −40° C. to 125° C.

The circuits 200 and 400 may be used for one of three functions. By connecting the emitter of qp3 (in FIG. 2) or qp5 (in FIG. 4) to ground, the circuit performs the same PTAT functions as circuits 100 and 300. When the emitter of qp3 or qp5 is not coupled to ground, the circuit provides a temperature independent reference voltage. Finally, the circuits may act as a PTAT current generator by mirroring the bias current of mp1.

The invention claimed is:

1. A proportional to absolute temperature (PTAT) circuit, the circuit comprising:

a first bipolar transistor arranged to generate a first base-emitter voltage and a first base current and a second bipolar transistor arranged to generate a second base-emitter voltage and a second base current, respective emitters of the first and second bipolar transistors biased at the same voltages; and a plurality of passive components, coupled to the first and second bipolar transistors, in which the plurality of passive components includes a series arrangement from ground of a first resistive component, a second resistive component, and a third resistive component;

wherein the first resistive component includes a first end that is connected to a base of the first bipolar transistor and a second end that is connected to a base of the second bipolar transistor such that a current through the first resistive component is determined by a difference in voltages between the respective bases of the first and second bipolar transistors;

wherein the circuit is configured to generate a PTAT output voltage using the plurality of passive components, which is dependent on a difference in the first and second base-emitter voltages; and the plurality of passive components are configured to compensate for the first and second base currents.

2. The PTAT circuit according to claim 1, wherein the circuit is configured to generate a voltage equivalent to the difference in the first and second base-emitter voltages across the first resistive component.

3. The PTAT circuit according to claim 2, wherein the passive components further comprise the second resistive component is driven by the base current of the first bipolar transistor, and the third resistive component is driven by the current through the first resistive component less the base current of the second bipolar transistor.

4. The PTAT circuit according to claim 3, wherein the second resistive component is coupled to the base of the first bipolar transistor and ground, and the third resistive component is coupled to the base of the second bipolar transistor and a PTAT circuit output.

5. The PTAT circuit according claim 4, wherein the circuit is configured such that the first base current increases a voltage drop across the second resistive component, and the second base current decreases a voltage drop across the third resistive component by a corresponding amount, thereby compensating for the first and second base currents.

6. The PTAT circuit according to claim 5, wherein the circuit is configured to generate:

a first current, proportional to the difference in the first and second base-emitter voltages, through the first resistive component;

a second current, equivalent to the first current plus the first base current, through the second resistive component; and a third current, equivalent to the first current minus the second base current, through the third resistive component.

7. The PTAT circuit according to claim 6, wherein the first and third resistive components are resistors having substantially equal resistances.

8. The PTAT circuit according to claim 7, wherein the circuit is configured to generate a voltage across the second resistive component that depends on the second current, and to generate a second voltage across the third resistive component that depends on the third current, thereby compensating for the base currents in the first and second bipolar transistors when summing individual series voltages across the series arrangement of the first, second, and third resistive components.

9. The PTAT circuit according to claim 1, wherein the circuit is configured to generate substantially identical base currents from the first and second bipolar transistors.

10. The PTAT circuit according claim 1, wherein the PTAT output voltage is independent of the first and second base currents.

11. The PTAT circuit according claim 1, further comprising an operational amplifier, wherein a non-inverting input of the amplifier is coupled to an emitter of the first bipolar transistor, and an inverting input of the amplifier is coupled to an emitter of the second bipolar transistor, and collectors of the first and second bipolar transistors are coupled to ground.

12. The PTAT circuit according to claim 1, further comprising a plurality of field-effect transistors (FETs), wherein a drain of each respective FET is coupled to a corresponding emitter of each of the first and second bipolar transistors.

13. The PTAT circuit according to claim 11, further comprising a plurality of FETS, wherein a drain of each of a respective FET is coupled to each respective emitter of each of the first and second bipolar transistors, wherein an output of the amplifier is coupled to the gates of the plurality of FETs.

14. The PIM circuit according claim 1, further comprising one or more additional bipolar junction transistors configured in a stack arrangement.

15. The PTAT circuit according to claim 1, included in a temperature independent voltage reference circuit, with a first complimentary to absolute temperature (CTAT) component, coupled to the PTAT circuit.

16. The PTA circuit of claim 15, wherein the CTAT component is a CTAT bipolar junction transistor, and the passive components are coupled to an emitter of the CTAT bipolar junction transistor.

17. The PTAT circuit according to claim 1, included in a voltage reference circuit comprising:

a CTAT component, coupled to the PTAT circuit, and a switching mechanism arranged to selectively connect the PTAT circuit and the CTAT component, such that, in a first mode the PTAT circuit and the CTAT component are connected to provide a temperature independent voltage reference, and in a second mode the PTAT circuit and the CTAT component are not connected to provide a PTAT voltage reference.

18. The temperature independent voltage reference of claim 1, in which the first and second resistive components form a voltage divider providing an undivided voltage to a base of one of the first and second bipolar transistors and a divided voltage to a base of the other of the first and second bipolar transistors, and in which the third resistive component is in series with the voltage divider.

19. A temperature independent voltage reference, the circuit comprising:

a first bipolar transistor arranged to generate a first base-emitter voltage and a first base current and a second bipolar transistor arranged to generate a second base-emitter voltage and a second base current, respective emitters of the first and second bipolar transistors biased at the same voltages;

a plurality of passive components, coupled to the first and second bipolar transistors, in which the plurality of passive components includes a series arrangement from ground of a first resistive component, a second resistive component, and a third resistive component, and wherein the first resistive component includes a first end that is connected to a base of the first bipolar transistor and a second end that is connected to a base of the second bipolar transistor such that the current through the first resistive component provides a proportional to absolute temperature (PTAT) component determined by a difference in voltages between the respective bases of the first and second bipolar transistors; and a complementary to absolute temperature (CTAT) component, coupled to the plurality of passive components;

wherein the circuit is configured to generate a temperature independent output voltage, across the PTAT component developed using the plurality of passive components and the CTAT component; and the plurality of passive components are configured to compensate for the first and second base currents.

20. A method of generating a proportional to absolute temperature (PTAT) voltage, the method comprising:

providing a circuit comprising a first bipolar transistor, a second bipolar transistor and a series arrangement from ground of first, second, and third resistive components, coupled to the first and second bipolar transistors, wherein respective emitters of the first and second bipolar transistors are biased at the same voltages;

generating, at the first bipolar transistor, a first base-emitter voltage and a first base current and, at the second bipolar transistor, a second base-emitter voltage and a second base current;

generating a PTAT output voltage, across the first resistive component, which is dependent on a difference in the first and second base-emitter voltages; and compensating for the first and second base currents by generating offsetting voltages in the second and third resistive components in the series arrangement to compensate for the effect of the first and second base currents on the PTAT output voltage.

* * * * *